United States Patent [19]

Vidoni et al.

[11] 4,030,800

[45] June 21, 1977

[54] CONNECTOR CAP WITH CORD GRIP

[75] Inventors: John Vidoni; Bhartoor Lingaraju; John C. Timmins, all of Allentown, Pa.

[73] Assignee: Square D Company, Park Ridge, Ill.

[22] Filed: Mar. 4, 1976

[21] Appl. No.: 663,860

Related U.S. Application Data

[63] Continuation of Ser. No. 546,330, Feb. 3, 1975, abandoned.

[52] U.S. Cl. ..... 339/107; 339/103 R

[51] Int. Cl.[2] ..... H01R 13/58

[58] Field of Search ..... 339/103 R, 103 C, 103 M, 339/107

[56] References Cited

UNITED STATES PATENTS

| | | | |
|---|---|---|---|
| 3,204,215 | 8/1965 | Danesi | 339/103 R |
| 3,328,748 | 6/1967 | Winter | 339/107 |
| 3,622,942 | 11/1971 | Rynk | 339/107 |

*Primary Examiner*—Roy Lake
*Assistant Examiner*—DeWalden W. Jones
*Attorney, Agent, or Firm*—Louis V. Schiavo

[57] ABSTRACT

One end of a dead front is nested in and covered by a back plate. The end of a cord may be threaded through a hole in the back plate for connection of its conductors to terminal plates housed in the dead front. Integral with the back plate is means for clamping the cord to the back plate thereby to relieve strain on the connections of the conductors to the terminal plates.

The hole in the back plate is defined by an area of the back plate which is segmented and thereby made flexible. Within limits, a cord of a diameter larger than that of the normal size of the hole may be accommodated by forcing the same past the segments and thereby enlarging the hole as required for passage of the cord therethrough.

1 Claim, 9 Drawing Figures

CONNECTOR CAP WITH CORD GRIP

This is a continuation of application Ser. No. 546,330, filed Feb. 3, 1975 now abandoned.

BACKGROUND OF THE INVENTION

1. Field of the Invention

The present invention relates to connector caps of the types called attachment plugs or cord connectors, and more particularly to such caps having a dead front to protect and insulate the cord terminals and eliminate the chances of short circuits and shocks.

2. Description of the Prior Art

Connector caps molded of plastic material and provided with cord grips that are integral therewith are known. For a teaching of such connector caps of both the attachment plug and the cord connector types reference may be had to U.S. Pat. No. 3,328,748, issued to Paul H. Winter on June 27, 1967. A connector cap constructed in accordance with said teaching is not entirely satisfactory. Flexible arms extend from the back plate to carry the parts between which the cord is clamped. The arms extend from the back plate as continuations of the wall of the hole through which the cord is threaded, and, as a consequence, they lack the degree of flexibility best suited for satisfactorily positioning the clamp parts about the cord.

In addition, when the diameter of the hole through which the cord is threaded corresponds to that of the cord, the hole is effectively sealed against introduction of foreign matter into the connector cap through the hole. Since the diameter of the hole is fixed, a cord which has a diameter smaller than that of the hole cannot be used without leaving a space extending about the cord through which foreign matter may enter the connector cap.

SUMMARY OF THE INVENTION

The principal object of the present invention is to provide a connector cap with improved means for clamping the connector cap to the cord. Another object of the present invention is to provide a connector cap wherein the clamp parts are carried by arms extending from areas of the back plate remote from the cord hole.

Still another object of the present invention is to provide a connector cap wherein the clamp parts are carried by arms which extend from the back plate as continuations of the outer peripheral wall thereof.

A further object of the present invention is to provide a connector cap with a back plate having a central hole through which any cord of a diameter within a predetermined range may be threaded without leaving a space extending about the cord through which foreign matter may enter the connector cap.

Figure 1:
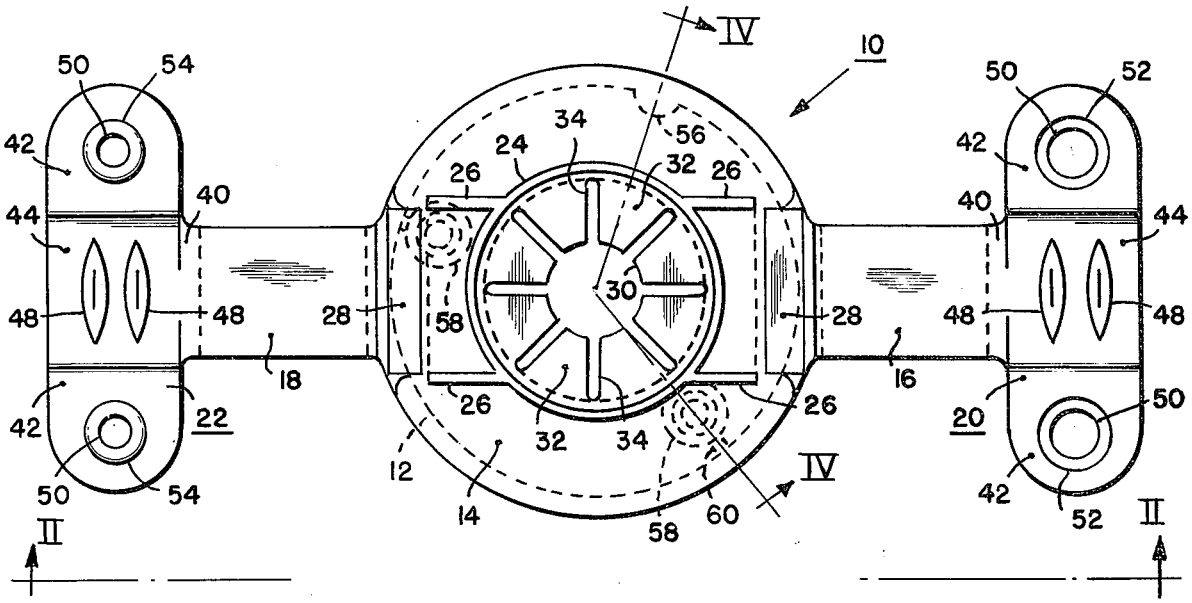
FIG. 1 is a view looking forwardly at a back plate for a dead front connector cap constructed in accordance with the present invention.

DESCRIPTION OF THE PREFERRED EMBODIMENT:

The following description is directed to the specific form of the invention shown in the drawings. It is not addressed to the scope of the invention, which may be practiced in a wide variety of forms.

Preferably, the exemplary back plate illustrated in FIGS. 1-4, generally designated 10, is a molded member of semirigid dielectric plastic material, such, for example, as nylon. The back plate comprises a hollow cylindrical wall 12 partially closed at its aft end by a cross-axially extending wall, generally designated 14, and open at its fore end. In addition, extending outwardly in opposite directions from the aft end of the wall 12 are a pair of arms 16 and 18 respectively mounting a pair of clamp parts 20 and 22.

Disposed centrally upon and extending rearwardly from the wall 14 is a short collar 24, and disposed on each side of the collar is a pair of laterally spaced gusset plates 26 which brace the collar against the wall 14. Extending outwardly from the area of the wall 14 between the plates 26 on each side of the back plate is a peripheral area of the wall 14, designated 28, which slopes forwardly.

The wall 14 is provided with a central hole 30 defined by the ends of a group of segments 32 formed by a series of very narrow recesses 34 extending radially outwardly from the hole nearly to the base of the collar 24. The area of the wall 14 bounded by the collar 24 and affording the segments 32 is reduced in thickness sufficiently to assure flexibility of the segments.

The arms 16 and 18 are in the form of narrow flexible straps which extend a short distance rearwardly respectively from the junctures of the areas 28 of the wall 14 with the wall 12, as at 36, and then continue outwardly, as at 38, in opposite directions respectively to the clamp parts 20 and 22. At the junctures of the arms 16 and 18 respectively with the clamp parts 20 and 22, the arms 16 and 18 are reduced in thickness, as at 40.

The arms 16 and 18 are equal in length so that clamp parts 20 and 22 are disposed thereby equidistant from the central axis of the back plate. The arms are parallel to one another, and the clamp parts 20 and 22 are disposed respectively normal to the arms 16 and 18, parallel to one another.

The clamp part 20 carried by the arm 16 is in the form of a rectangular bar the opposite end portions 42 of which are separated by an intermediate portion 44 which is arcuate in transverse section. The bar is disposed with its concave surface 46 and a pair of suitably formed elements 48 protruding therefrom facing aft. The opposite end portions of the bar are provided with holes 50 countersunk as at 52. The clamp 22 carried by the arm 18 similar to the clamp part 20. However, the countersink 52 is omitted, and, instead, the opposite end portions of the bar are provided with bosses 54 of a size for being received by the countersink 52 provided in the clamp part 20.

Extending longitudinally of the cylindrical wall 12, on the inner side thereof, are an indexing element 56 and a pair of bosses 58. The elemenet 56 extends the full length of the wall 12. The bosses 58 extend forwardly from the wall 14 a predetermined distance and are tied into the wall 12 by webs 60. Each of the bosses is provided with a central hole 62 extending there into from the fore end thereof.

Figure 5:
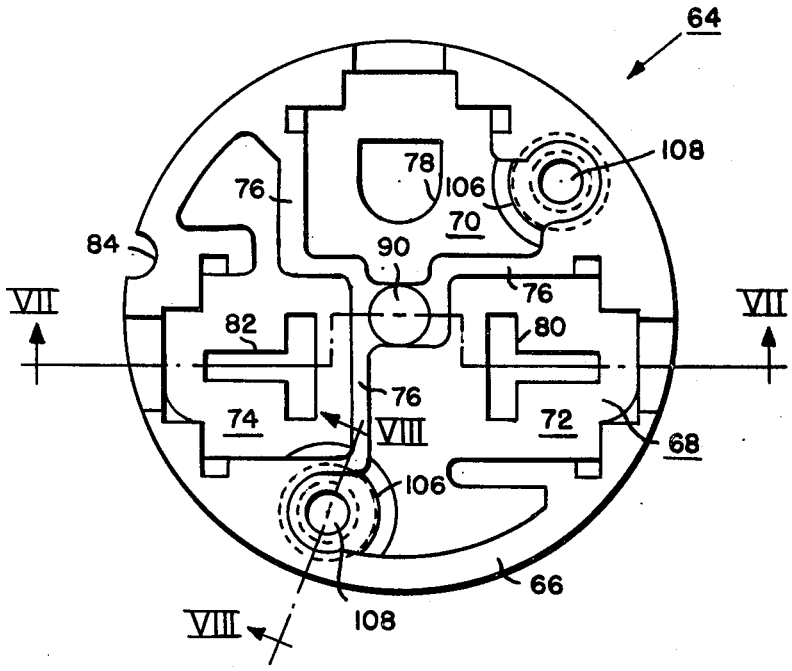
FIG. 5 is a view looking forwardly into a dead front for a connector cap constructed in accordance with the present invention.
Figure 7:
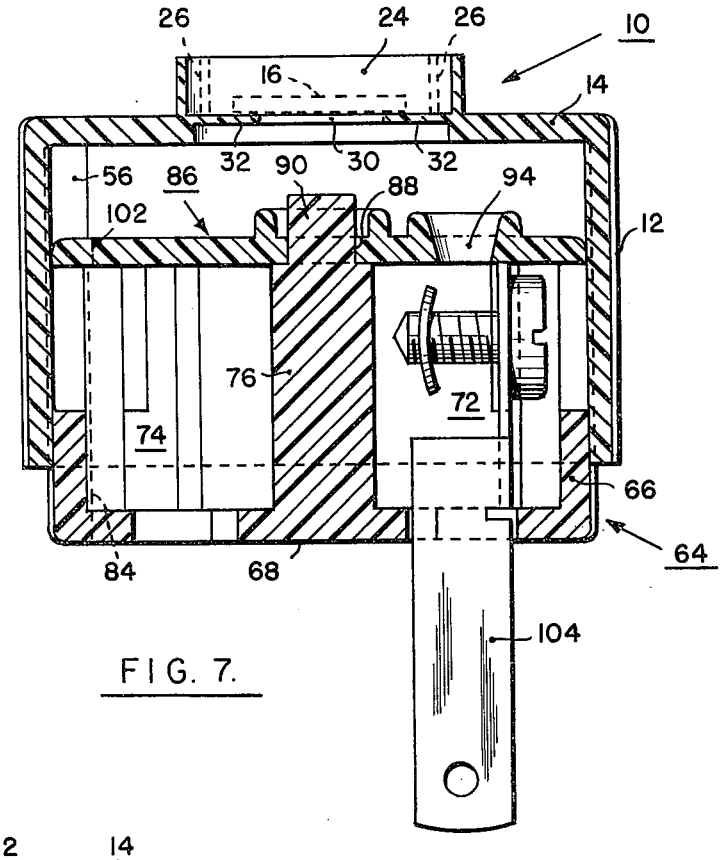
FIG. 7 is a section on lines VII—VII in FIG. 5 indicating how the dead front, washer, back plate and terminal plates are assembled.
Figure 8:
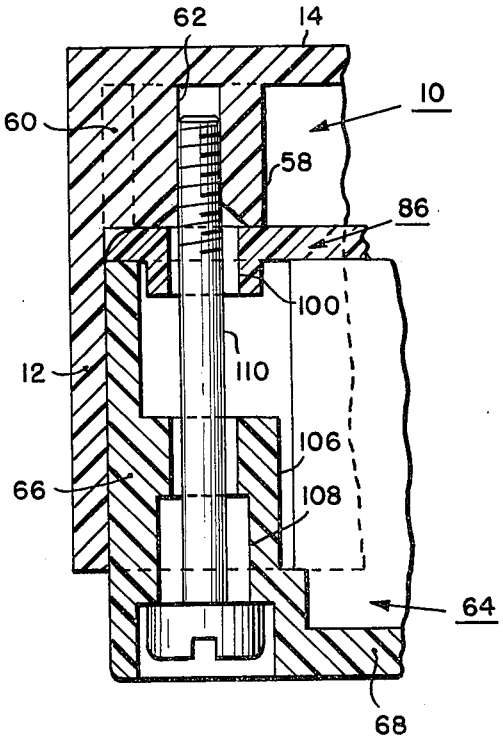
FIG. 8 is a section on lines VIII—VIII in FIG. 5 indicating how the dead front, washer and back plate are detachably secured together.

Preferably, the exemplary dead front illustrated in FIGS. 5, 7 and 8, generally designated 64, is molded of the same material as the back plate 10 and comprises a hollow cylindrical wall 66 partially closed at its fore end by a cross axially extending wall generally designated 68 and open at its aft end. The interior of the dead front is suitably divided into three compartments 70, 72 and 74 by a system of partitions generally designated 76. The wall 68 is provided with suitable openings 78, 80 and 82 for accommodating attachment prongs respectively housed in the several compartments, as will be understood by those skilled in the art. The outer surface of the wall 66 is provided with an indexing groove 84 extending the full length thereof.

Figure 6:
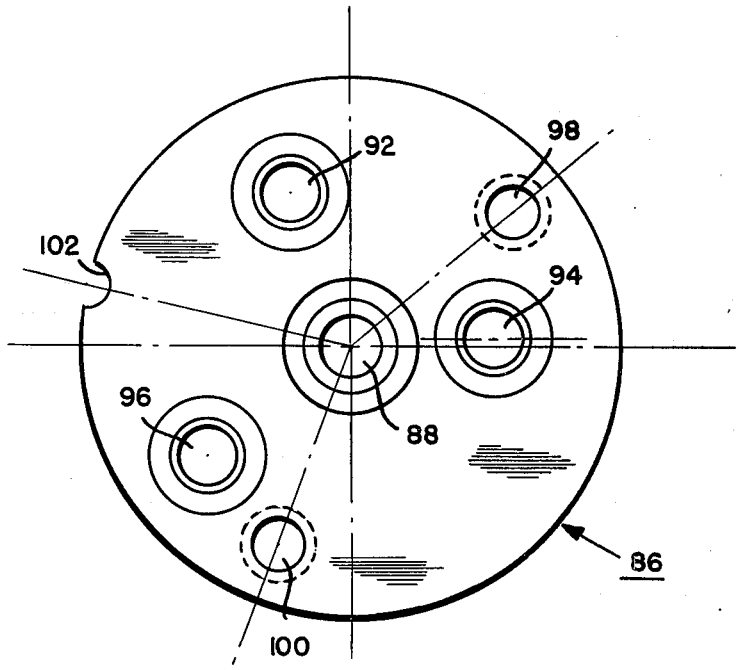
FIG. 6 is a view looking forwardly at a washer for the dead front shown in FIG. 5.

Referring particularly to FIG. 6, preferably the washer illustrated is a flat disc 86 molded of a dielectric plastic material and provided with a central hole 88 of a size to receive a centrally disposed pintle 90 extending aft from the top of the partition 76, holes 92, 94 and 96 each of a size through which one of the conductors of the cord may be threaded, and holes 98 and 100 for accommodating screws. The outer peripheral area of the washer is provided with a notch 102 for receiving the indexing element 56.

Referring particularly to FIGS. 7 and 8, in the assembly of the connector cap, the attachment prongs, designated 104, are suitably housed in the dead front, and the washer 86 is seated upon the aft end of the dead front, the pintle 90 being projected through the opening 88. Then the washer 86 is turned about the pintle until the notch 102 registers with the groove 84 in the side of the dead front, whereupon the holes 92, 94 and 96 respectively register with the compartments 70, 72 and 74. Then the back plate is positioned over the assembled dead front and washer with the indexing element 56 aligned with the notch 102 in the washer and the groove 84 in the dead front and pressed forwardly until the fore ends of the bosses 58 seat upon the washer 86.

The dead front is provided interiorly with a pair of bosses 106 adjacent the wall 66 and extending aft from the wall 68. The bosses are provided with countersunk holes 108 for a pair of screws 110, which extend aft through the holes 98 and 100 in the washer for being threaded into the bosses 58 of the back plate. Thus the dead front, washer and back plate are detachably secured together.

In the use of the connector cap, first the dead front, washer and back plate are disassembled. Then the cord, designated 112, is threaded through the hole 30 in the back plate, the end thereof stripped and the conductors thus bared, designated 114, 116 and 118, threaded respectively through the holes 92, 94 and 96 and conventionally connected to the attachment prongs. Now the several parts of the connector cap are reassembled. The next step is to clamp the cord and the connector cap together.

Figure 2:
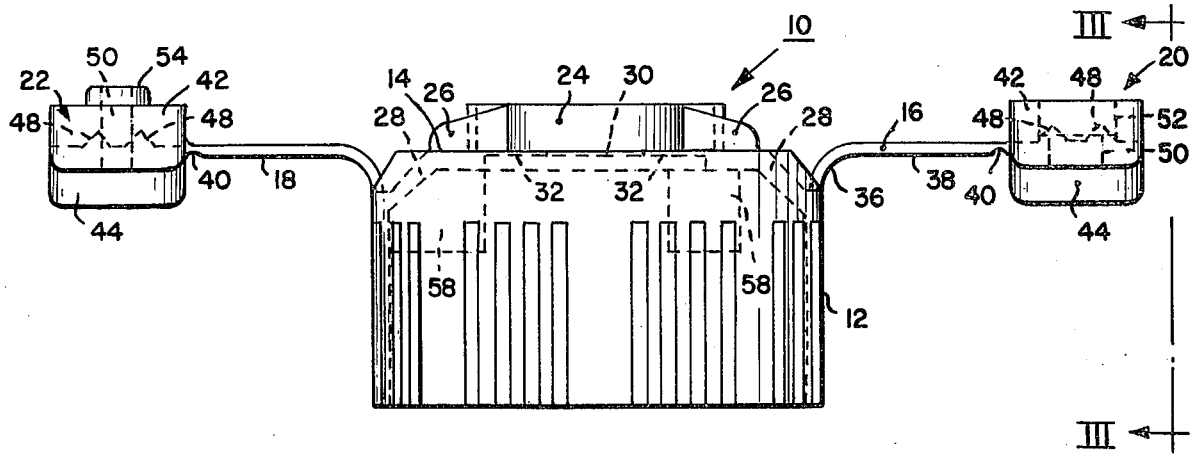
FIG. 2 is a view looking at one side of the back plate shown in FIG. 1, as indicated by the lines II—II in FIG. 1.
Figure 3:
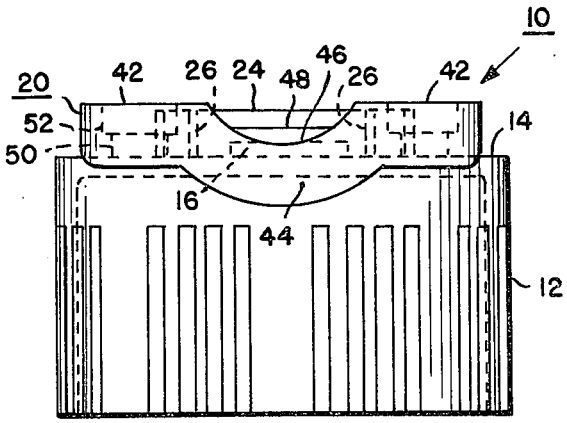
FIG. 3 is a view looking at another side of the back plate shown in FIG. 1, as indicated by the lines III—III in FIG. 2.
Figure 4:
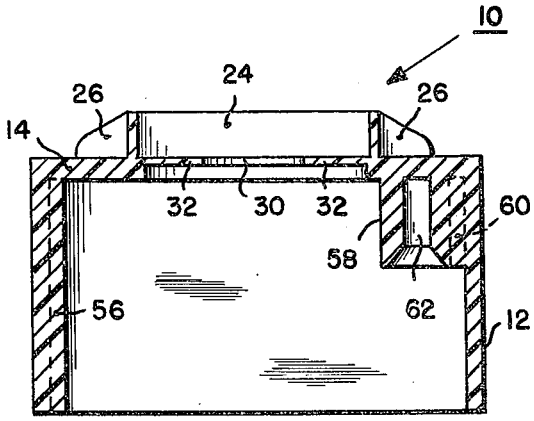
FIG. 4 is a section on lines IV—IV in FIG. 1.
Figure 9:
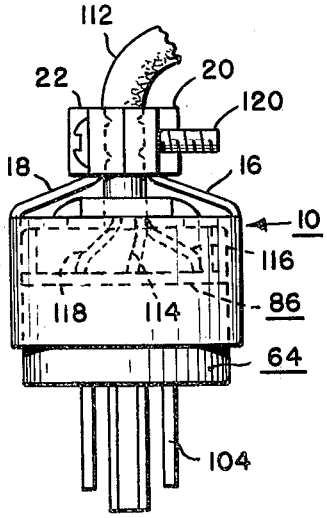
FIG. 9 is a view looking at a side of the connector cap and showing the cap clamped to a cord.

From the positions thereof illustrated in FIG. 2, the clamp parts 20 and 22 are turned aft and inwardly toward one another approximately to the positions thereof shown in FIG. 9. Then a pair of screws 120 are projected through the holes 50 respectively in the opposite end portions of one of the clamp parts and threaded into the holes 50 respectively in the opposite end portions of the other clamp part. As the screws 120 are turned in, the bosses 54 of the clamp part 22 respectively nest in the countersinks 52 of the clamp part 20, and the elements 48 of the clamp parts bite into the cord until the clamp parts assume the positions thereof illustrated in FIG. 9, in which positions the arcuate portions 44 respectively of the clamp parts conjointly embrace and securely grip the cord.

It will be appreciated that flexibility of the arms 16 and 18 is essential, and that the degree of flexibility depends largely upon the length of the arms. The longer the arms, the greater the flexibility. At the same time, it is very desirable to locate the clamp parts 16 and 18 close to the wall 14 of the back plate. Therefore, the arms 16 and 18 are arranged to extend aft from outer peripheral areas of the wall 14 respectively at angles of approximately seventy degrees to the central axis of the connector cap, instead of parallel to said axis, as taught by the prior art patent to Paul H. Winter, noted hereabove.

When a cord 112 having a diameter greater than that of the cord hole 30 is threaded through the back plate, the segments 32 which define the cord hole are bent forwardly by the cord. As a consequence, the cord hole is enlarged as required to accommodate the cord. Thus, within a predetermined range, a cord smaller than the largest which the back plate will accommodate may be threaded through the back plate without leaving a space extending around the cord through which foreign matter may enter the connector cap.

While in accordance with the provisions of the patent statutes, I have illustrated and described the best form or embodiment of my invention now known to us, it will be apparent to those skilled in the art that changes may be made in the form of the connector cap described without departing from the spirit and scope of the invention as set forth in the appended claim. For example, whether the dead front houses female or male type terminal contact units is of no consequence. In addition, whether or not the dead front houses a ground blade is immaterial.

We claim:

1. In a dead front electrical connector cap integrally molded of a semi-rigid dielectric material, a back plate comprising A. a wall extending across said back plate and having a hole therein for accommodating a cord threaded there through from rear to front, the area of said wall defining said hole being provided with a plurality of angularly spaced very narrow recesses extending radially outward from the center of said hole thereby to form of said area a plurality of closely spaced apart flexible segments normally disposed in a common plane with said wall and resiliently deflectable out of said common plane, said very narrow recesses having a width substantially less than the width of said flexible segments, said relatively wide segments and said very narrow recesses therebetween providing a flexible structure to define a variable diameter aperture which also provides an effective barrier against entry of foreign matter, B. a pair of arms connected to and extending from diametrically opposite areas of said wall, and C. a pair of clamp parts respectively connected to and carried by said arms, said arms being connected to said wall for being disposed in rearwardly converging relation, with said clamp parts disposed in embracing relation to said cord for being secured together and thereby clamping said cord therebetween.

* * * * *